US008966828B1

(12) United States Patent
Garcia

(10) Patent No.: US 8,966,828 B1
(45) Date of Patent: Mar. 3, 2015

(54) SHED WITH RAILS

(71) Applicant: Osvaldo Garcia, Hialeah, FL (US)

(72) Inventor: Osvaldo Garcia, Hialeah, FL (US)

( * ) Notice: Subject to any disclaimer, the term of this patent is extended or adjusted under 35 U.S.C. 154(b) by 0 days.

(21) Appl. No.: 13/725,210

(22) Filed: Dec. 21, 2012

(51) Int. Cl.
*E04B 1/346* (2006.01)
*E04B 1/343* (2006.01)

(52) U.S. Cl.
CPC ..... *E04B 1/343* (2013.01)
USPC ..... 52/64; 52/67; 52/69

(58) Field of Classification Search
CPC . E04B 1/343; E04B 1/34336; E04B 1/34352; E04H 6/005; E04H 6/02; E04H 6/04; E04H 12/18
USPC ..... 52/64, 67, 69, 79.1, 79.5, 143, 238.1, 52/243.1
See application file for complete search history.

(56) References Cited

U.S. PATENT DOCUMENTS

| | | | | |
|---|---|---|---|---|
| 2,992,709 | A * | 7/1961 | McIntosh | 52/64 |
| 3,469,356 | A * | 9/1969 | White | 52/71 |
| 4,035,965 | A * | 7/1977 | Ronai | 52/69 |
| 4,133,571 | A * | 1/1979 | Fillios | 52/67 |
| 8,074,403 | B1 * | 12/2011 | Mentnech | 52/72 |
| 8,137,045 | B2 * | 3/2012 | Roberto et al. | 414/540 |
| 2007/0028529 | A1 * | 2/2007 | Carter | 52/64 |

* cited by examiner

*Primary Examiner* — Mark Wendell
(74) *Attorney, Agent, or Firm* — Jesus Sanchelima; Christian Sanchelima

(57) ABSTRACT

A shed with a wall assembly movable along a path defined by a pair of floor rail assemblies cooperatively aligned with a deployable outer rail assembly to provide access to the items stored in the shed. A pair of wheel assemblies is interiorly mounted to the side walls of the wall assembly to support the latter. A handle is provided to pull shed housing. Legs mounted to the underside of a floor assembly keep the latter at a spaced apart relationship with respect to a supporting surface.

10 Claims, 7 Drawing Sheets

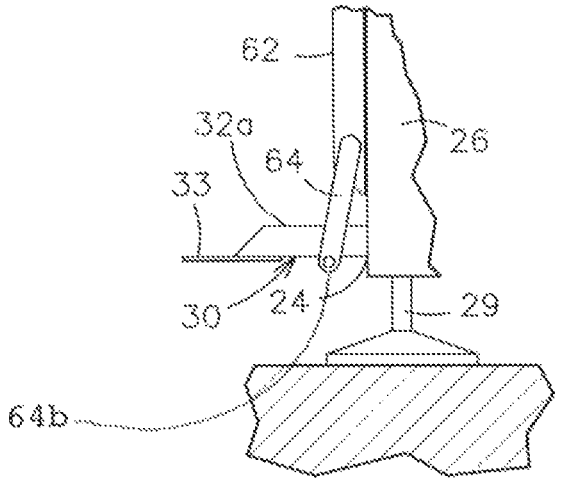
FIG. 5
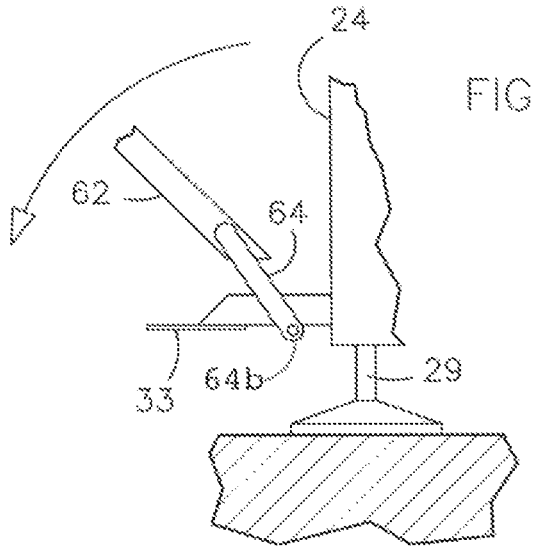
FIG. 5A
FIG. 5B
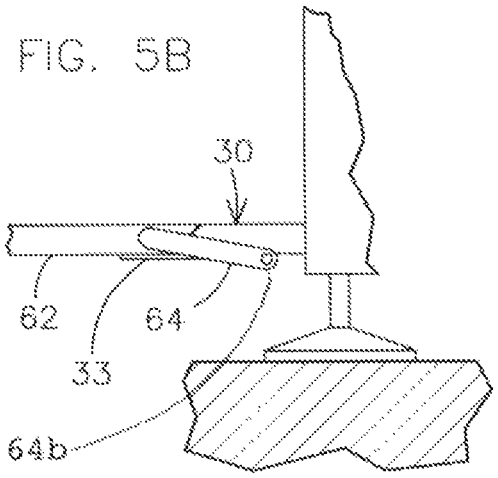

SHED WITH RAILS

BACKGROUND OF THE INVENTION

1. Field of the Invention

The present invention relates to storage sheds.

2. Description of the Related Art

Several designs for storage sheds have been designed in the past. None of them, however, include rails that permit the selective movement of the shed's walls to expose the stored items. The typical storage shed requires a user to enter or reach the items stored through a door or window. This results in very limited access for some of the stored objects specially those in the back. With the present invention, a user has complete access to the stored items since walls are moved temporarily exposing what is stored.

SUMMARY OF THE INVENTION

It is one of the main objects of the present invention to provide a storage shed with walls that can readily moved to expose the items in storage.

It is another object of this invention to provide such a shed that is volumetrically efficient.

It is yet another object of this invention to provide such a shed that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 5 is a partial elevational view of a corner of shed 10 showing outer rail member 62 in the vertical (not deployed) position with floor rail member 32 of assembly 30 protruding through end wall 24.

FIG. 5A is similar to the previous figure and shows outer rail member 62 being lowered with pivotally mounted extension arm 64.

FIG. 5B like the previous two figures, shows outer rail member 62 which is now in its resting horizontal position being partially supported by supporting extension 33.

DETAILED DESCRIPTION OF THE EMBODIMENTS OF THE INVENTION

Figure 1A:
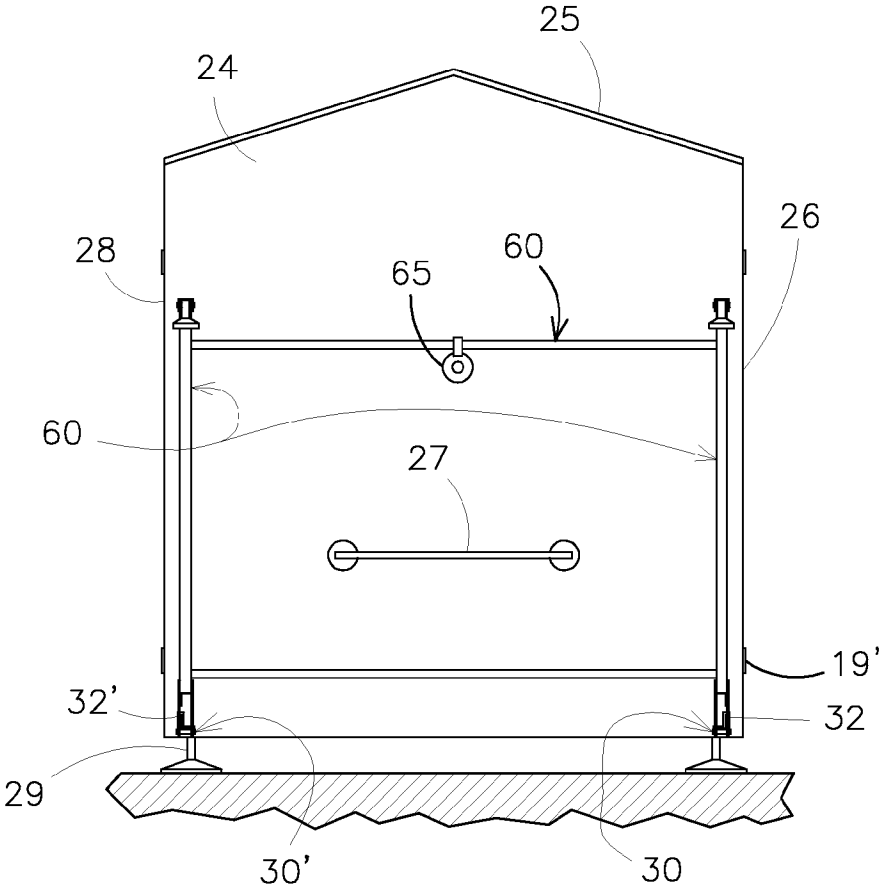
FIG. 1A is a rear elevational view of the shed represented in the previous figure.

Referring now to the drawings, where the present invention is generally referred to with numeral 10, it can be observed that it basically includes shed assembly 20 and pivotally mounted rail assembly 60 over which assembly 20 rides when deployed. This allows a user to have access to the items is storage having handle 27 mounted thereon.

Figure 1:
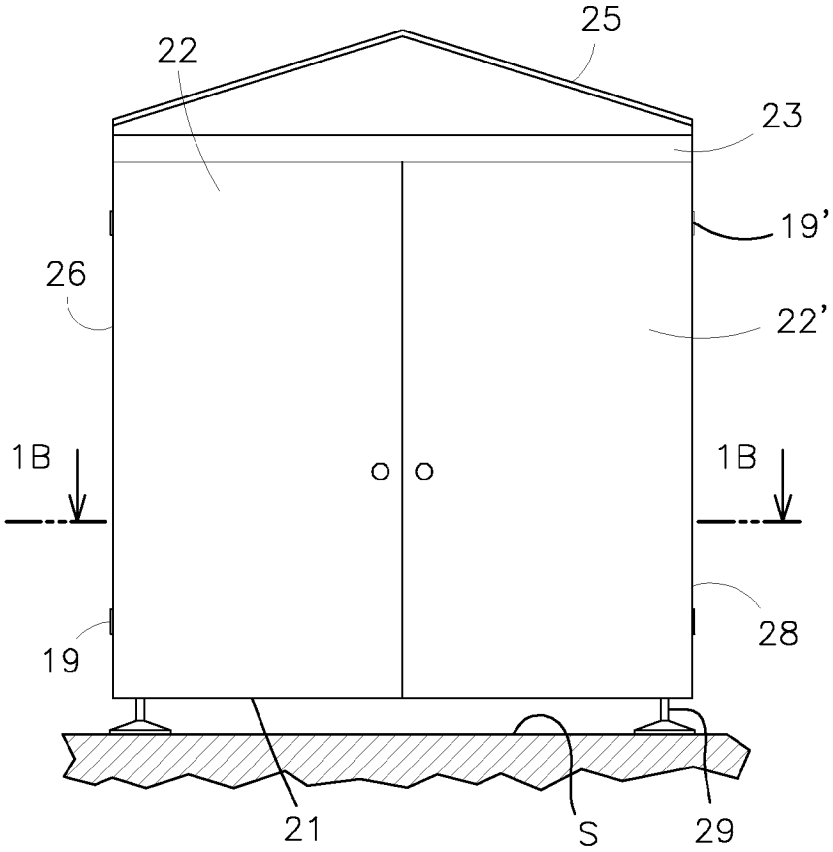
FIG. 1 represents a front elevational view of one of the embodiments for a shed incorporating the present invention.
Figure 1B:
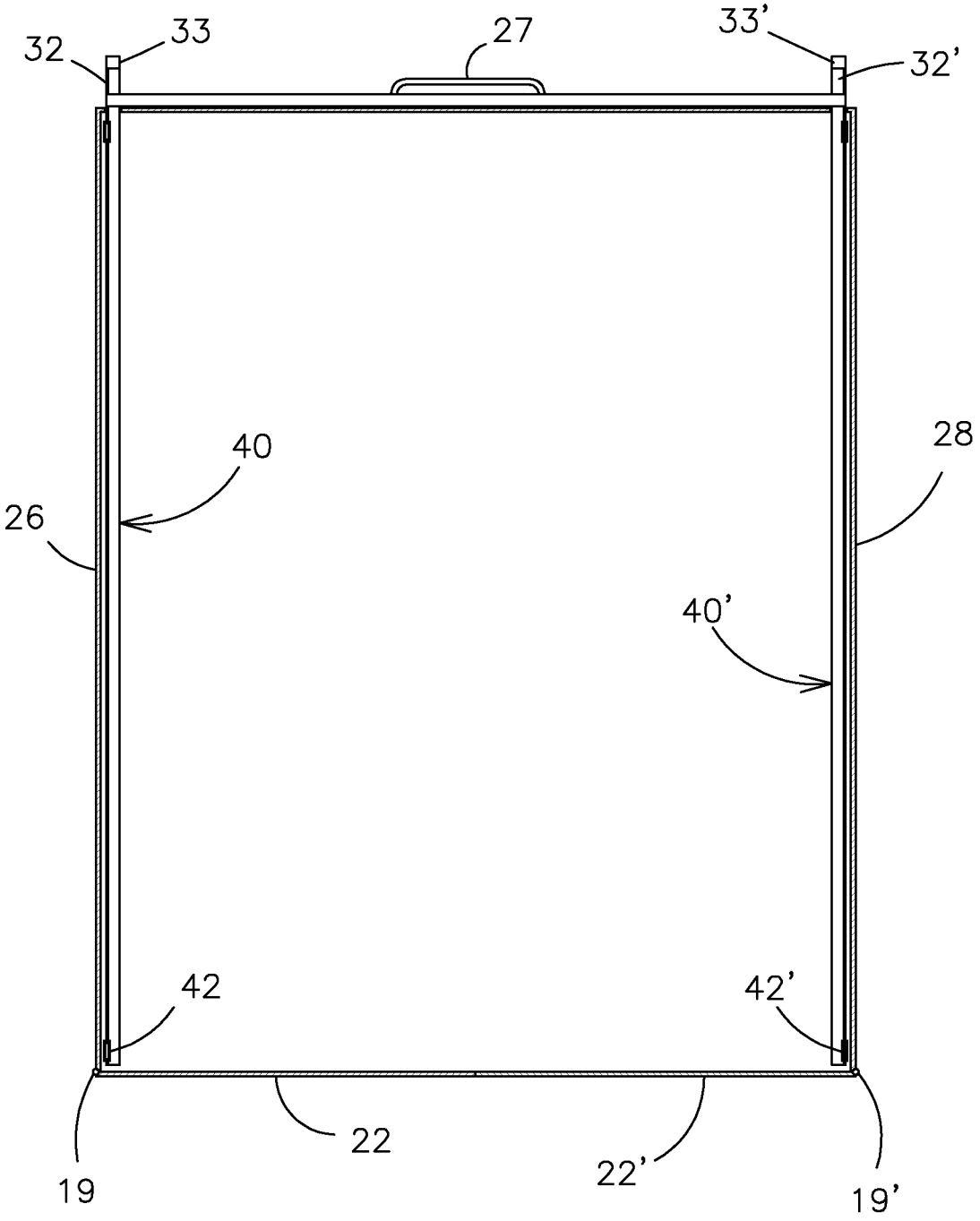
FIG. 1B is a top view taken from cutting line 1B-1B in FIG. 1.
Figure 2:
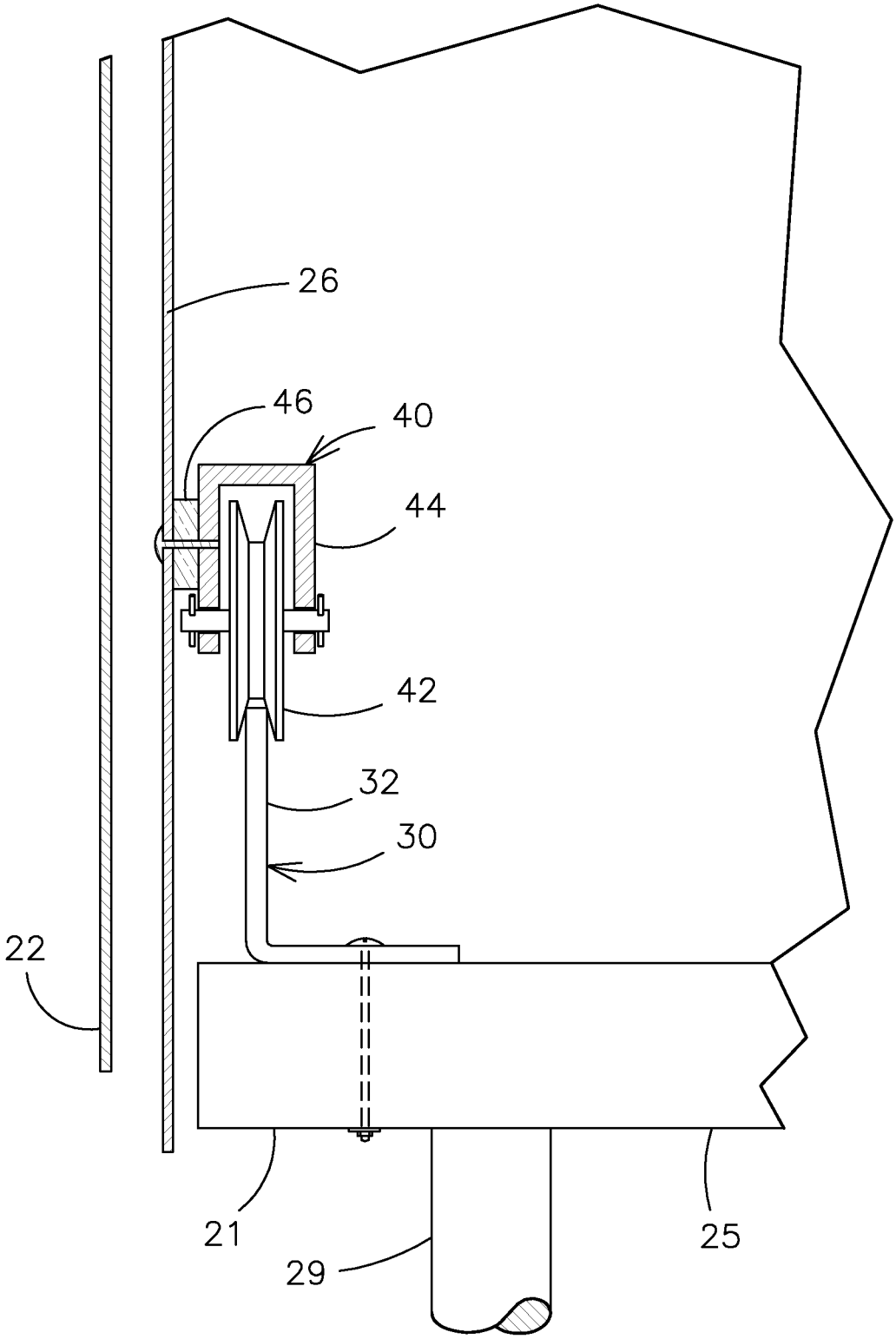
FIG. 2 is an enlarged elevational view of floor rail assembly 30 and wheel assembly 40.
Figure 3:
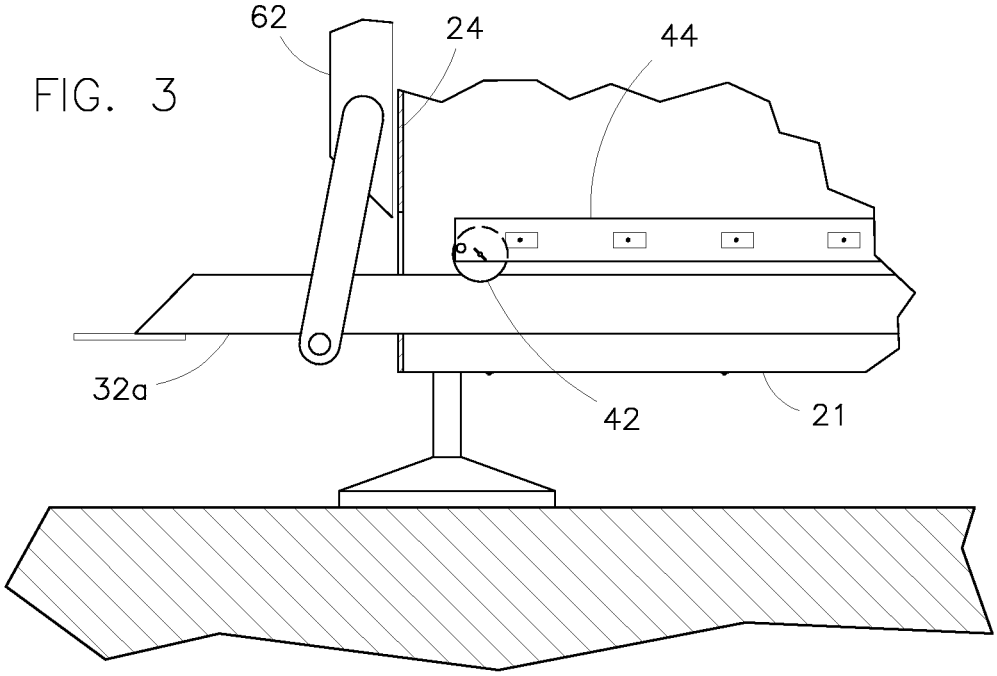
FIG. 3 is an elevational view of the portion of shed 10 (with side wall 26 removed) showing floor rail member 32 protruding through end wall 24.
Figure 4:
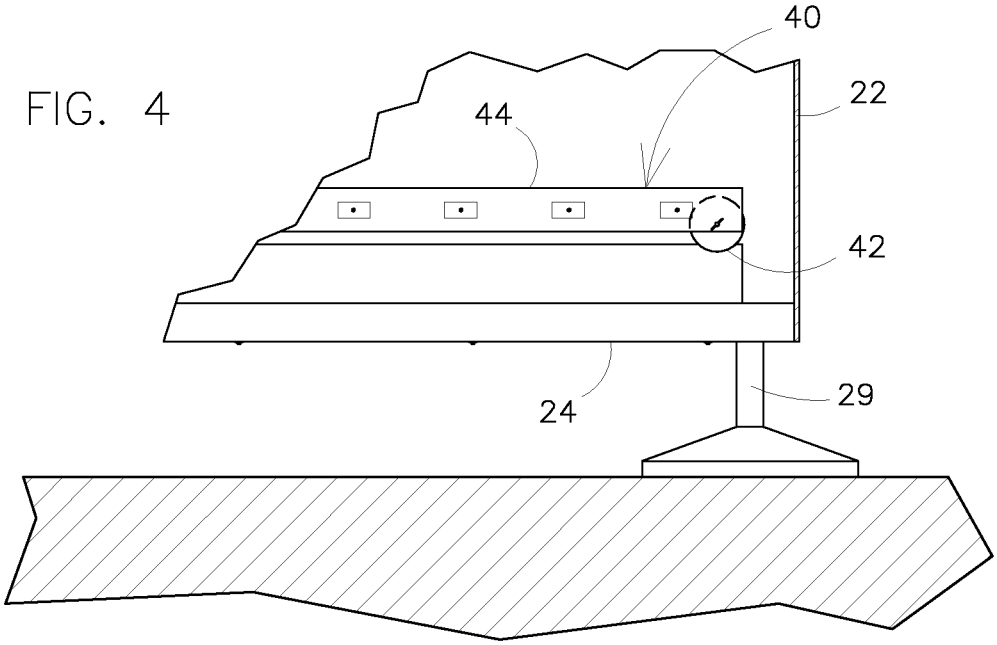
FIG. 4 is an elevational view of a portion of shed 10 (with side wall 26 removed) showing the internal disposition of floor rail assembly 30 and wheel assembly 40.

Shed wall or housing assembly 20 includes doors 22; 22' rear wall 24 and side include hinges 19; 19' to support the former walls 26 and 28, as best seen in FIGS. 1 and 1A. Doors 22; 22' define the fourth side. In other embodiments shed 10 does not have doors 22; 22' and the fourth side is covered by a vertical structure such as a wall. Top or roof 25 is mounted on walls 24; 26; 28. The fourth side may include doors 22; 22' that can extend the entire height of the other sides or include a transversal structure 23 to enhance the structural integrity of shed wall assembly 20. Floor or platform assembly 21 is perpendicularly disposed with respect to walls 24, 26; 28 to support the latter through floor rail assemblies 30 and 30' and wheel assemblies 40; 40'. Rail members 32; 32' extend out beyond floor assembly 21. Leg members 29 mounted to the underside of floor assembly 21 keep the latter at a parallel and spaced apart relationship with respect to a supporting surface. Wheel assemblies 40; 40' are interiorly mounted to side wall 26 and 28, respectively. In one of the embodiments wheel member 42 is mounted inside a C-shape bar 44, as best seen in FIG. 5. Spacers 46 keep bar 44 at spaced apart from wall 26. A similar arrangement is found for wheel assembly 40'. Outer rail assembly 60 is pivotally mounted to the protruding end 32*a* of member 32 through pivotally mounted arm 64 at a location adjacent to the lower edge of wall 24. Arm 64 is rigidly mounted to rail member 62 at end 64 and pivotally mounted to the underside of rail member 32 at end 64*b*, as best seen in FIGS. 5; 5A and 5B. Rail member 62 is cooperatively mounted to be selectively deployed in the horizontal position in alignment with floor rail assembly 30 to permit wheels 35 to continuously ride from floor rail member 32 to rail member 62.

Figure 6A:
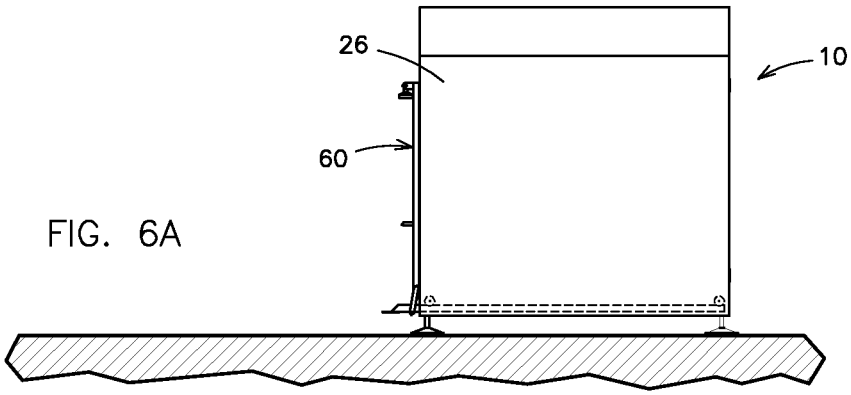
FIG. 6A shows the first figure of a sequence of side elevational representations showing the operation of the shed represented in the previous figure. In this figure shed 10 is closed and rail assembly 60 is in the retracted (upright) position.
Figure 6B:
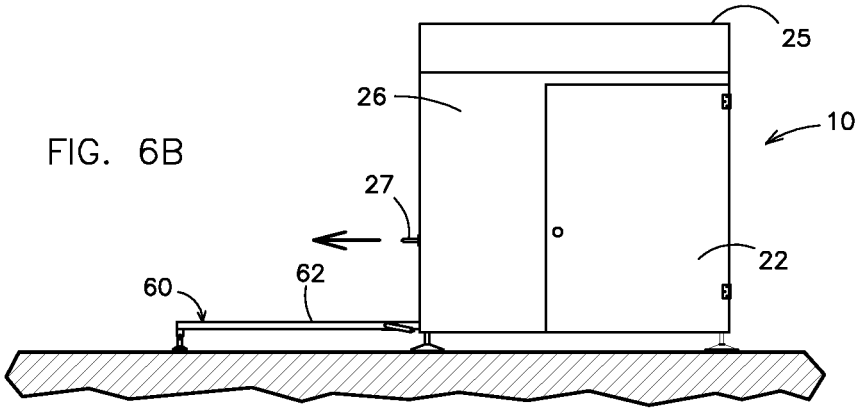
FIG. 6B shows the shed shown in the previous figure with the doors (only one door is shown) open and exterior rail assembly 60 lowered to the horizontal position and with an arrow indicating a force about to be applied.
Figure 6C:
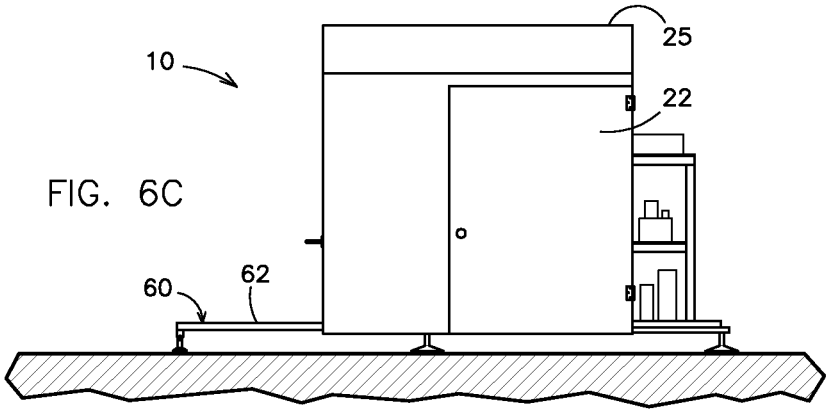
FIG. 6C shows shed 10 partially moved to the left riding over deployed assembly 60.
Figure 6D:
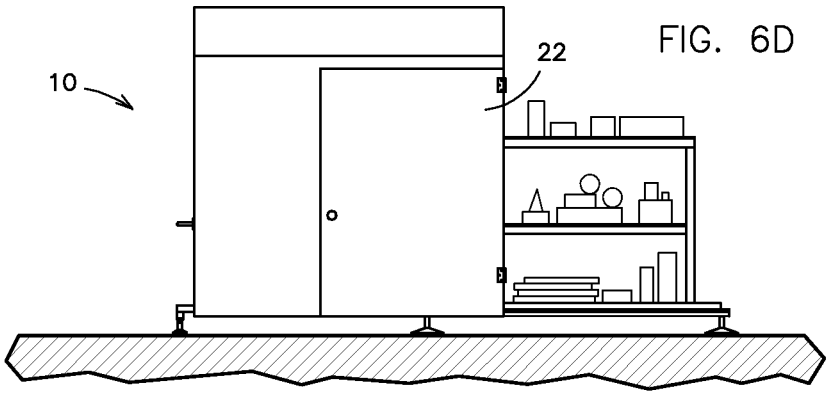
FIG. 6D shows shed 10 completely moved to the left.
Figure 7A:
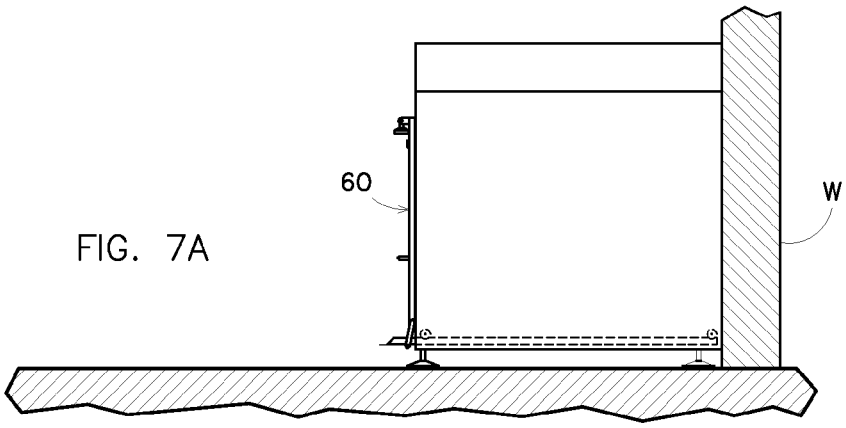
FIGS. 7A through 7D is a sequence of figures similar to FIGS. 2A through 2D without using doors 22; 22' since the front side is closed with a vertical wall, thereby saving space.
Figure 7B:
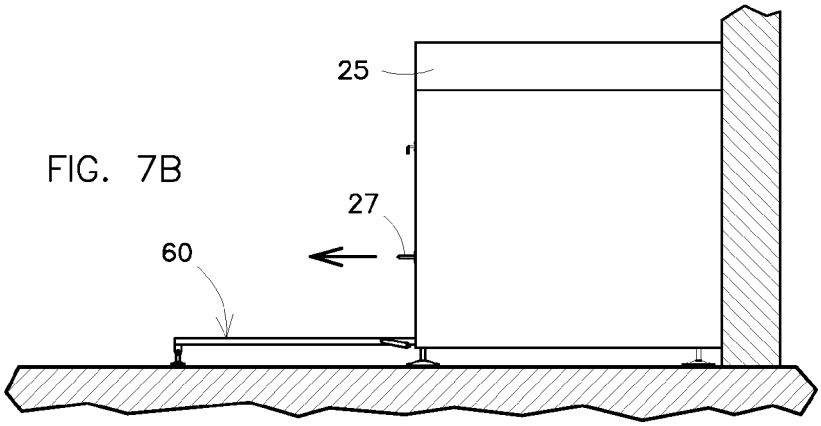
Figure 7C:
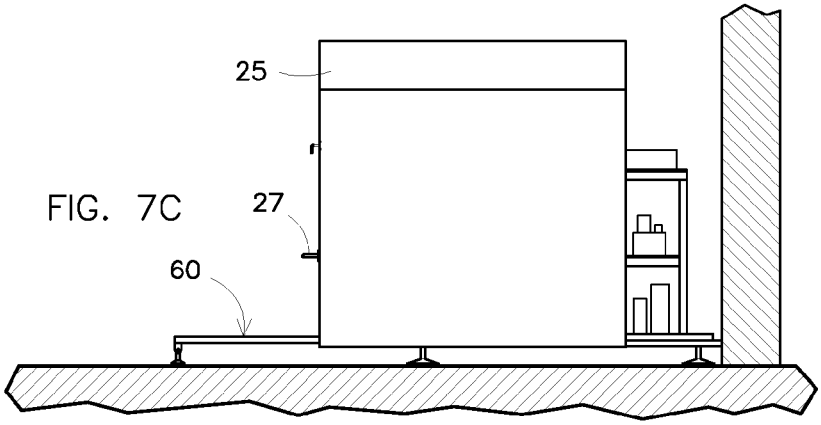
Figure 7D:
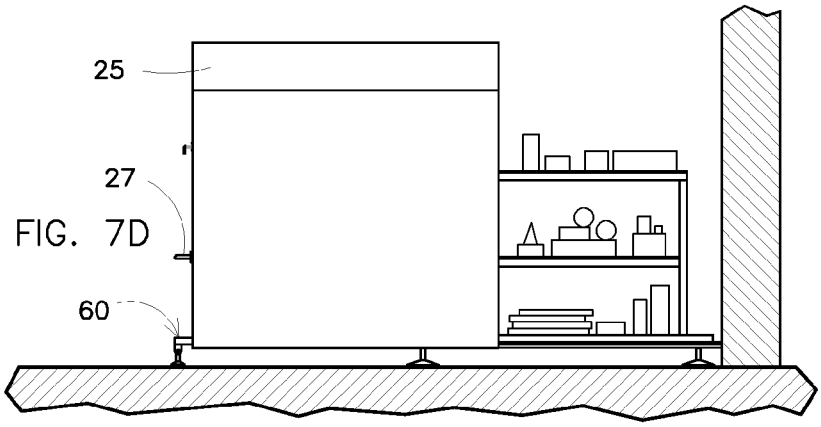

FIGS. 6A through 6D show the operation of shed 10. Doors 22; 22' are opened in FIG. 5B and placed parallel to side walls 26 and 28. As seen in FIG. 1A, latch member 65 releasably locks said assembly 60 in the vertical position. Then, rail assembly 60 is placed in a horizontal position over supporting surface S. Wall assembly 20 is then moved to the left riding over rail assembly 60, as seen in FIGS. 6C and 6D. As seen in FIG. 1A, latch member 65 releasably locks rail assembly 60 in the vertical position.

FIGS. 7A through 7D are similar to FIGS. 6A through 6D, except that wall assembly 20 does not include doors 22; 22'. Instead a vertical wall W is used to close the side where doors 22; 22' would otherwise be installed. This embodiment is used where space limitations require it.

The foregoing description conveys the best understanding of the objectives and advantages of the present invention.

Different embodiments may be made of the inventive concept of this invention. It is to be understood that all matter disclosed herein is to be interpreted merely as illustrative, and not in a limiting sense.

What is claimed is:

1. A shed comprising:

A) a floor assembly kept at a spaced apart and substantially parallel relationship with respect to a supporting surface and said floor assembly further having an upper surface, and further including a floor rail assembly having first and second longitudinally extending floor rail assemblies mounted to said upper surface and disposed at a parallel spaced apart relationship from each other;

B) a rigid wall assembly including first and second side walls, each having substantially the same height and width dimensions, and a rear wall having the same height as said first and second side walls and perpendicularly mounted to said first and second side walls that are kept at an opposite and spaced apart relationship with respect to each other, and a top mounted substantially perpendicularly to said first, second and third walls at a spaced apart relationship with respect to said floor assembly;

C) first and second wheel assemblies interiorly mounted to said first and second side walls cooperatively coacting with said first and second floor rail assembly to ride thereon and to cause said wall assembly to move along a path defined by said first and second rail assemblies; and D) an exterior rail assembly pivotally mounted adjacent to said rear wall lowermost end to cooperatively extend said path from said first and second floor rail assemblies when deployed in substantially the same plane of said first and second rail assemblies to allow said wall assembly to ride thereon thereby exposing said floor assembly.

2. The shed set forth in claim 1 further including a fourth side having a door assembly mounted to said first side walls.

3. The shed set forth in claim 2 wherein said rear wall includes a handle mounted exterior of said rear wall.

4. The shed set forth in claim 3 wherein said fourth side includes a transversal structural member mounted to said first and second side walls adjacent to said top thereby enhancing the structural integrity of said housing assembly.

5. The shed set forth in claim 4 wherein said floor assembly includes a plurality of leg members to support and keep said floor assembly at a parallel and spaced apart relationship with respect to a supporting surface.

6. The shed set forth in claim 5 wherein said exterior rail assembly includes a latch member for releasably keeping said exterior rail assembly in the vertical position parallel to said rear wall.

7. The shed set forth in claim 1 further including closure means mounted to said first and second side walls opposite to said rear wall.

8. The shed set forth in claim 7 further including leg means for supporting said floor assembly and keeping the latter at a spaced apart relationship with respect to a supporting surface.

9. The shed set forth in claim 8 wherein said first and second rail assemblies include first and second rail members that extend outwardly beyond said rear wall and predetermined distance and said exterior rail assembly is pivotally mounted to the distal ends of said first and second rail members.

10. The shed set forth in claim 9 wherein said exterior rail assembly includes a latch member for releasably keeping said exterior rail assembly in the vertical position adjacent to said rear wall.

* * * * *